US007044194B2

(12) United States Patent
Leeson et al.

(10) Patent No.: US 7,044,194 B2
(45) Date of Patent: May 16, 2006

(54) HEAT EXCHANGER WITH BEVELED HEADER

(75) Inventors: Jeffrey S. Leeson, South Euclid, OH (US); Eric K. Peoples, Ravenna, OH (US); Michael W. Brakey, Shaker Heights, OH (US)

(73) Assignee: Duramax Marine, LLC, Hiram, OH (US)

( * ) Notice: Subject to any disclaimer, the term of this patent is extended or adjusted under 35 U.S.C. 154(b) by 347 days.

(21) Appl. No.: 10/119,412

(22) Filed: Apr. 9, 2002

(65) Prior Publication Data

US 2002/0162643 A1 Nov. 7, 2002

Related U.S. Application Data

(63) Continuation-in-part of application No. 09/427,565, filed on Oct. 26, 1999, now abandoned.

(51) Int. Cl.

| | |
|---|---|
| ***B60H 3/00*** | (2006.01) |
| ***B63B 1/34*** | (2006.01) |
| ***B63H 21/10*** | (2006.01) |
| ***B63H 21/38*** | (2006.01) |
| ***F28F 9/06*** | (2006.01) |

(52) U.S. Cl. ..... 165/44; 165/41; 165/173; 440/88 R; 440/88 HE; 440/88 C

(58) Field of Classification Search ..... 165/44, 165/41, 173; 440/88 HE, 88 R, 88 C
See application file for complete search history.

(56) References Cited

U.S. PATENT DOCUMENTS

| | | | | |
|---|---|---|---|---|
| 1,838,722 | A | | 12/1931 | Watson |
| 2,382,218 | A | | 8/1945 | Fernstrum |
| 2,415,154 | A | | 2/1947 | Walter |
| 2,914,012 | A | * | 11/1959 | Godfrey et al. |
| 3,177,936 | A | | 4/1965 | Walter |
| 3,240,179 | A | | 3/1966 | Van Ranst |
| 4,043,289 | A | * | 8/1977 | Walter |
| 4,338,993 | A | | 7/1982 | Fernstrum |
| 4,484,622 | A | | 11/1984 | Satchwell |
| 4,557,319 | A | | 12/1985 | Arnold |
| 5,299,635 | A | | 4/1994 | Abraham |
| 5,529,117 | A | | 6/1996 | Voss et al. |
| 5,931,217 | A | | 8/1999 | Fernstrum |
| 6,099,373 | A | | 8/2000 | Fernstrum |
| 6,575,227 | B1 | * | 6/2003 | Leeson et al. ..... 165/44 |
| 6,896,037 | B1 | * | 5/2005 | Leeson et al. ..... 165/44 |
| 2003/0098141 | A1 | * | 5/2003 | Fernstrom |

FOREIGN PATENT DOCUMENTS

WO WO01/31264 * 5/2001

OTHER PUBLICATIONS

Fernstrum Gridcooler Catalog 995, no date.

* cited by examiner

*Primary Examiner*—John K. Ford
(74) *Attorney, Agent, or Firm*—D. Peter Hochberg; Sean Mellino; Katherine R. Vieyra

(57) ABSTRACT

A header for a heat exchanger, the header having a beveled closed end portion.

10 Claims, 11 Drawing Sheets

HEAT EXCHANGER WITH BEVELED HEADER

CROSS REFERENCE TO RELATED APPLICATION

This application is a continuation-in-part of U.S. Ser. No. 09/427,565 which was filed on Oct. 26, 1999 now abandoned.

BACKGROUND OF THE INVENTION

1. Field of the Invention

This invention relates to heat exchangers, and more particularly to heat exchangers for cooling engines, generators, gear boxes and other heat generating sources in industrial apparatuses having fluid cooled heat sources, such as marine vessels. The invention more particularly relates to open heat exchangers (where heat transfer tubes are exposed to the ambient cooling or heating fluid, rather than being in a shell to shell container holding the cooling or heating fluid) used for cooling heat sources, where the heat exchangers are efficient, and thus have lower weight and volume compared to other heat exchangers known in the art. Alternatively, the heat exchanger according to the invention could be used as a heater, wherein relatively cool fluid absorbs heat through the heat transfer tubes.

2. Description of the Prior Art

Heat generating sources in industrial applications such as marine vessels are often cooled by water, other fluids or water mixed with other fluids. For example, in marine vessels used in fresh water and/or salt water, the cooling fluid or coolant flows through the engine or other heat generating source where the coolant picks up heat, and then flows to another part of the plumbing circuit. The heat must be transferred from the coolant to the ambient surroundings, such as the body of water in which the vessel is located. For small engines, such as outboard motors for small boats, ambient water pumped through the engine is a sufficient coolant. However, as the vessel power demand gets larger, ambient water pumped through the engine may continue to provide good cooling of the engine, but also serves as a source of significant contamination damage to the engine. If raw, ambient water were used to cool the engine, the ambient water would carry debris and, particularly if it is salt water, corrosive chemicals to the engine. Therefore, there have been developed various apparatuses for cooling engines and other heat sources. One apparatus for cooling the engine of a vessel is channel steel, which is basically a large quantity of shaped steel which is welded to the bottom of the hull of a vessel for conveying engine coolant and transferring heat from the coolant to the ambient water. Channel steel has severe limitations: it is very inefficient, requiring a large amount of steel in order to obtain the required cooling effect; it is very expensive to attach to a vessel, since it must be welded to the hull—a very labor intensive operation; since channel steel is very heavy, the engine must be large enough to carry the channel steel, rendering both the initial equipment costs and the operating costs very high; the larger, more powerful engines of today are required to carry added channel steel for their cooling capacity with only a relatively small amount of room on the hull to carry it; the payload capacity is decreased; the large amount of channel steel is expensive; and finally, channel steel is inadequate for the present and future demands for cooling modern day, marine vessels. Even though channel steel is the most widely used heat exchanger for vessels, segments of the marine industry are abandoning channel steel and using smaller keel coolers for new construction to overcome the limitations cited earlier.

A keel cooler was developed in the 1940's and is described in U.S. Pat. No. 2,382,218 (Fernstrum). The Fernstrum patent describes a heat exchanger for attachment to a marine hull structure which is composed of a pair of spaced headers secured to the hull, and a plurality of heat conduction tubes, each of whose cross-section is rectangular, which extend between the headers. Cylindrical plumbing through the hull connects the headers to coolant flow lines extending from the engine or other heat source. Hot coolant leaves the engine, and runs into a heat exchanger header located beneath the water level (the water level refers to the water level preferably below the aerated water, i.e. below the level where foam and bubbles occur), either beneath the hull or on at least one of the lower sides of the hull. The coolant then flows through the rectangular heat conduction tubes and goes to the opposite header, from which the cooled coolant returns to the engine. The headers and the heat conduction tubes are disposed in the ambient water, and heat transferred from the coolant, travels through the walls of the heat conduction tubes and the headers, and into the ambient water. The rectangular tubes connecting the two headers are spaced fairly close to each other, to create a large heat flow surface area, while maintaining a relatively compact size and shape. Frequently, these keel coolers are disposed in recesses on the bottom of the hull of a vessel, and sometimes are mounted on the side of the vessel, but in all cases below the water line.

The foregoing keel cooler is referred to as a one-piece keel cooler, since it is an integral unit with its major components welded or brazed in place. The one-piece keel cooler is generally installed and removed in its entirety.

It is explained in U.S. Pat. No. 2,382,218 that, according to one embodiment of the heat exchanger disclosed therein, the pair of headers at opposite ends thereof have beveled fore and aft front and rear end walls. The latter walls are respectively connected to beveled front and rear inner walls (to which the open ports of the conduction tubes are connected to the chambers of the headers) by triangular-shaped side walls. There is thus no flat lower wall (since the triangular-shaped end walls meet at a point). Each header thus essentially consists of a flat rectangular upper wall, beveled inner and end walls extending downwardly from opposite ends of the upper wall and meeting at a lower point, and triangular side walls. The coolant inlet or outlet nipple is positioned in the upper wall directly over the point where the beveled inner wall meets the beveled end wall. Since the walls beneath the nipples are beveled in opposite directions, the flow of coolant to or from the nipples is helped in one respect because the fore and aft end parts of the header assists the coolant flow between the conduction tubes and the nipple, but hindered in another respect because the beveled inner walls direct coolant flow in the opposite direction from that rebounding from the end parts of the header. The oppositely directed coolant flow in the header causes turbulence, increases pressure drop and reduces coolant flow. The lower portion of each header, where the beveled inner and end wall converge at a point, is disposed below the open ports of the conduction tubes. This further reduces the coolant flow into and out of the respective headers; in the case of coolant flowing out of a header, coolant disposed below the ports must flow upward to reach the ports, against other coolant flowing downwardly. Such upward flow contributes to turbulence in the header, and is inefficient since gravity opposes such flow. Likewise, when coolant is flowing into this type of header to exit through the nipple, some coolant flows in the direction opposite to that of the nipple and must flow against gravity, past the cross-flow of coolant from the ports of the conduction tubes into the nipple. The latter arrangement also results in turbulence in the header, an increase in the pressure drop, and reduces coolant flow. In addition, none of the open ports are located in the coolant flow path from the nipple, so there is no direct flow path between the nipple and any of the open ports.

Furthermore, the beveled end wall is not configured either to direct a substantial amount of coolant into the flow tubes, or to direct a substantial amount of coolant from the flow tubes into the nozzle. This is because part of the beveled end wall is located below the open ports to the flow tubes, and because there are significant parts of the beveled inner wall which are flat and devoid of ports to the flow tubes.

These aspects of this embodiment of the heat exchanger disclosed in U.S. Pat. No. 2,382,218 may very well have determined why it was never put into commercial production.

There are various varieties of one-piece keel coolers. Sometimes the keel cooler is a multiple-pass keel cooler where the headers and heat conduction tubes are arranged to allow at least one 180° change in the direction of flow, and the inlet and outlet ports may be located in the same header.

Even though the foregoing heat exchangers with the rectangular heat conduction tubes have enjoyed widespread use since their introduction over fifty years ago, they have shortcomings which are corrected by the present invention.

The rectangular heat exchangers of the prior art have the outward shape of a rectangular parallelepiped having headers at their opposite ends. These headers have opposing end walls which are perpendicular to the hull of the vessel and parallel to each other, and act as a barrier to ambient water flow relative to the keel cooler as the vessel with the heat exchanger travels through the water. The perpendicular header walls are responsible for the creation of dead spots (lack of ambient water flow) on the heat exchanger surfaces, which largely reduce the amount of heat transfer occurring at the dead spots. In addition, the perpendicular walls diminish the flow of ambient water between the heat conduction tubes, which reduces or diminishes the amount of heat which can be transferred between the coolant in the tubes and the ambient water.

As discussed below, the beveled header contributes to the increase of the overall heat transfer efficiency of the keel cooler according to the invention, since the ambient water is caused to flow towards and between the respective heat conduction tubes, rendering the heat transfer substantially higher than in the keel cooler presently being used. This increase in heat transfer is due at least in part to the increase in turbulence in the flow of ambient water across the forward header and along and between the coolant flow tubes.

One of the important aspects of keel coolers for vessels is the requirement that they take up as small an area on the vessel as possible, while fulfilling or exceeding their heat exchange requirement with minimized pressure drops in coolant flow. The area on the vessel hull which is used to accommodate a keel cooler is referred to in the art as the footprint. In general, keel coolers with the smallest footprint and least internal pressure drops are desirable. One of the reasons that the keel cooler described above with the rectangular heat conduction tubes has become so popular is because of the small footprint it requires when compared with other keel coolers. However, keel coolers according to the design of rectangular tubed keel coolers presently being used have been found by the present inventors to be larger than necessary both in terms of size and the related internal pressure drop. By the incorporation of the various aspects of the present invention described above (and in further detail below), keel coolers having smaller footprints and lower internal pressure drops are possible. These are major advantages of the present invention.

When multiple pass (usually two-pass) keel coolers are specified for the present state of the art, an even greater differential size is required when compared with the present invention, as described below.

SUMMARY OF THE INVENTION

It is an object of the present invention to provide a heat exchanger for fluid cooled heat sources which is smaller than corresponding heat exchangers having the same heat exchange capability.

Another object of the present invention is to provide an improved heat exchanger for industrial applications which is more efficient than heat exchangers presently known and used.

It is yet another object of the present invention to provide an improved one-piece heat exchanger for vessels which is more efficient in heat transfer than presently known one-piece heat exchangers.

A further object is to provide an improved one-piece heat exchanger which reduces the pressure drop of coolant flowing therethrough.

A further object of the present invention is to provide an improved one-piece heat exchanger having heat conduction tubes which are rectangular in cross-section having a length which is reduced in size from the current heat exchangers due to enhanced ambient water flow across the keel cooler.

Another object is to provide an improved one-piece heat exchanger having a reduced size from present one-piece heat exchangers of comparable heat transfer capability, by reducing the length of the heat transfer tubes, the number of tubes and/or the size of the tubes.

Another object of the present invention is to provide a header for a one-piece keel cooler heat exchanger with an interior wall for improving the coolant flow between the inlet/outlet and the open ports of the keel cooler tubes.

It is yet another object to provide a header for a one-piece keel cooler with an interior wall for directing the coolant flow between the inlet/outlet and the open ports of the keel cooler tubes for reducing turbulence of the coolant in the header.

A still further object of the present invention is to provide a new one-piece heat exchanger having rectangular shaped heat conduction tubes which has enhanced durability compared to keel coolers presently on the market.

A related object of the invention is to provide an improved heat exchanger and headers thereof which is capable of deflecting debris more readily, and for presenting a smaller target to debris in the ambient water.

Another object of the present invention is to provide an improved one-piece keel cooler which is easier to install on vessels than corresponding keel coolers presently on the market.

Yet a further object of the present invention is to provide a one-piece heat exchanger and a header having a lower weight, and therefore lower cost, than corresponding one-piece heat exchangers presently in use.

Another object of the present invention is to provide a one-piece heat exchanger and headers thereof having rectangular heat conduction tubes having a lower pressure drop in coolant flowing through the heat exchanger than corresponding heat exchangers presently known.

Another object of the present invention is the provision of a one-piece heat exchanger for a vessel, for use as a retrofit for previously installed one-piece heat exchangers which will surpass the overall heat transfer performance and provide lower pressure drops than the prior units without requiring additional plumbing, or requiring additional space requirements, to accommodate a greater heat output.

It is another object of the invention to provide an improved header for a one-piece heat exchanger having rectangular coolant flow tubes.

Another object is to provide an improved header for a one-piece heat exchanger with rectangular coolant flow tubes which reduces the dead spots which have heretofore reduced the heat transfer capabilities of one-piece heat exchangers, the dead spots reducing the flow of ambient water around and between the coolant flow tubes.

A further object of the invention is to provide an improved header for a one-piece keel cooler with rectangular coolant flow tubes, by reducing the likelihood of damage to the header from striking debris and underwater objects which could damage the keel cooler.

It is still another object for the provision of a header for effecting increased turbulent flow of the ambient water flowing between and around the heat transfer tubes.

It is an additional object to provide an improved header for one-piece keel coolers which enables the anode for such keel coolers to be less likely to strike debris and underwater objects.

Another object is the provision of a keel cooler having a smaller, and more streamlined profile to reduce drag as the vessel with the keel cooler moves through the ambient water.

Another object is to provide a header for a one-piece heat exchanger which provides for enhanced heat exchange between the coolant and the ambient cooling medium such as water.

A general object of the present invention is to provide a one-piece heat exchanger and headers thereof which is efficient and effective in manufacture and use.

Other objects will become apparent from the description to follow and from the appended claims.

The invention to which this application is directed is a one-piece heat exchanger, i.e. heat exchangers having two headers which are integral with coolant flow tubes. It is particularly applicable to heat exchangers used on marine vessels as discussed earlier, which in that context are also called keel coolers. However, heat exchangers according to the present invention can also be used for cooling heat generating sources (or heating cool or cold fluid) in other situations such as industrial and scientific equipment, and therefore the term heat exchangers covers the broader description of the product discussed herein. The heat exchanger includes two headers, and one or more coolant flow tubes integral with the header. Although keel coolers use ambient water as the cooling medium, the broader term for a cooling medium is a heat sink or a fluid heat sink.

BRIEF DESCRIPTION OF THE DRAWINGS

FIG. 14 is a pictorial view of a two-pass keel cooler system according to the invention;

FIG. 15 is a cut away view of a portion of the header shown in FIG. 16;

FIG. 16 is a pictorial view of a multiple system combined, having two single-pass portions, according to the invention;

FIG. 17 is a pictorial view of a keel cooler according to the invention, having a single-pass portion and a double-pass portion; and FIG. 18 is a pictorial view of two double-pass systems according to the invention.

DESCRIPTION OF THE PREFERRED EMBODIMENTS

Figure 1:
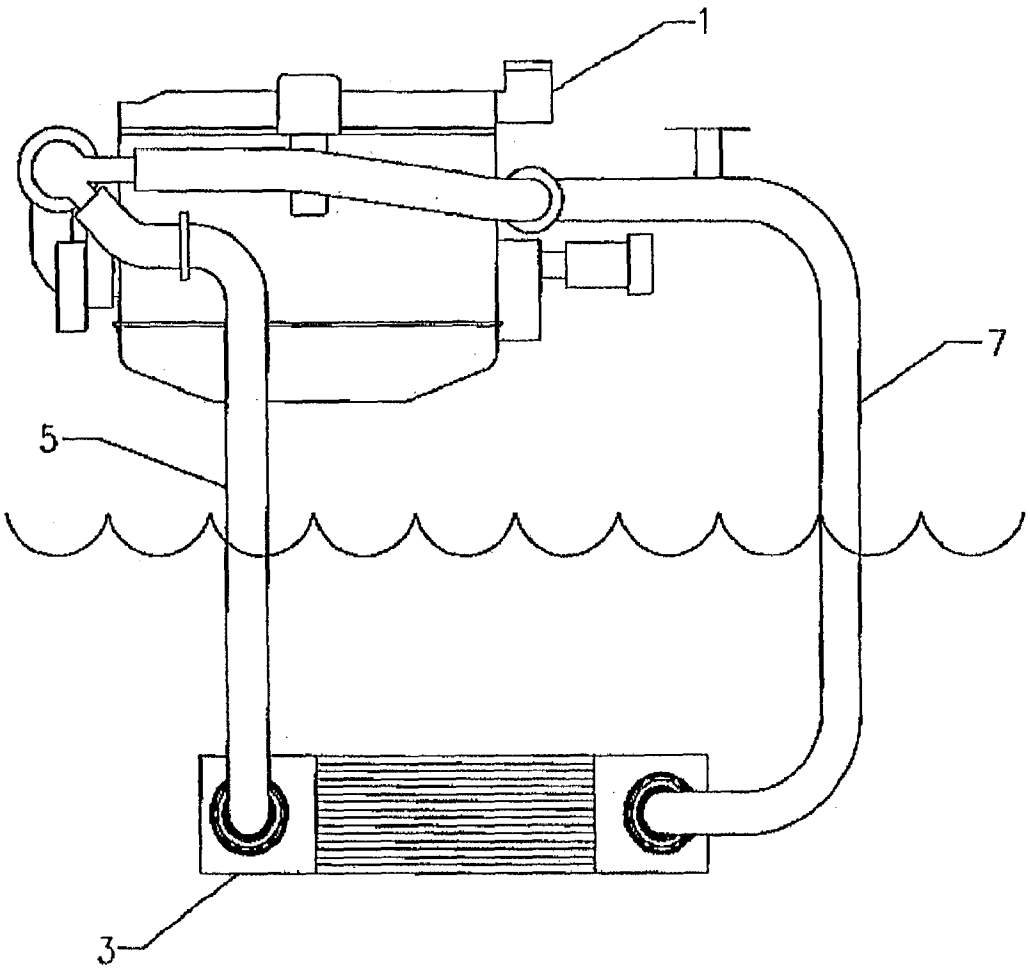
FIG. 1 is a schematic view of a heat exchanger on a vessel in the water.

The fundamental components of a heat exchanger system for a water-going vessel are shown in FIG. 1. The system includes a heat source 1, a heat exchanger 3, a pipe 5 for conveying the hot coolant from heat source 1 to heat exchanger 3, and a pipe 7 for conveying cooled coolant from heat exchanger 3 to heat source 1. Heat source 1 could be an engine, a generator or other heat source for the vessel. Heat exchanger 3 could be a one-piece keel cooler (since only one-piece keel coolers are discussed herein, they are generally only referred to herein as "keel coolers.") Heat exchanger 3 is located in the ambient water, below the water line (i.e. below the aerated water line), and heat from the hot coolant is transferred through the walls of heat exchanger 3 and expelled into the cooler ambient water.

Figure 2:
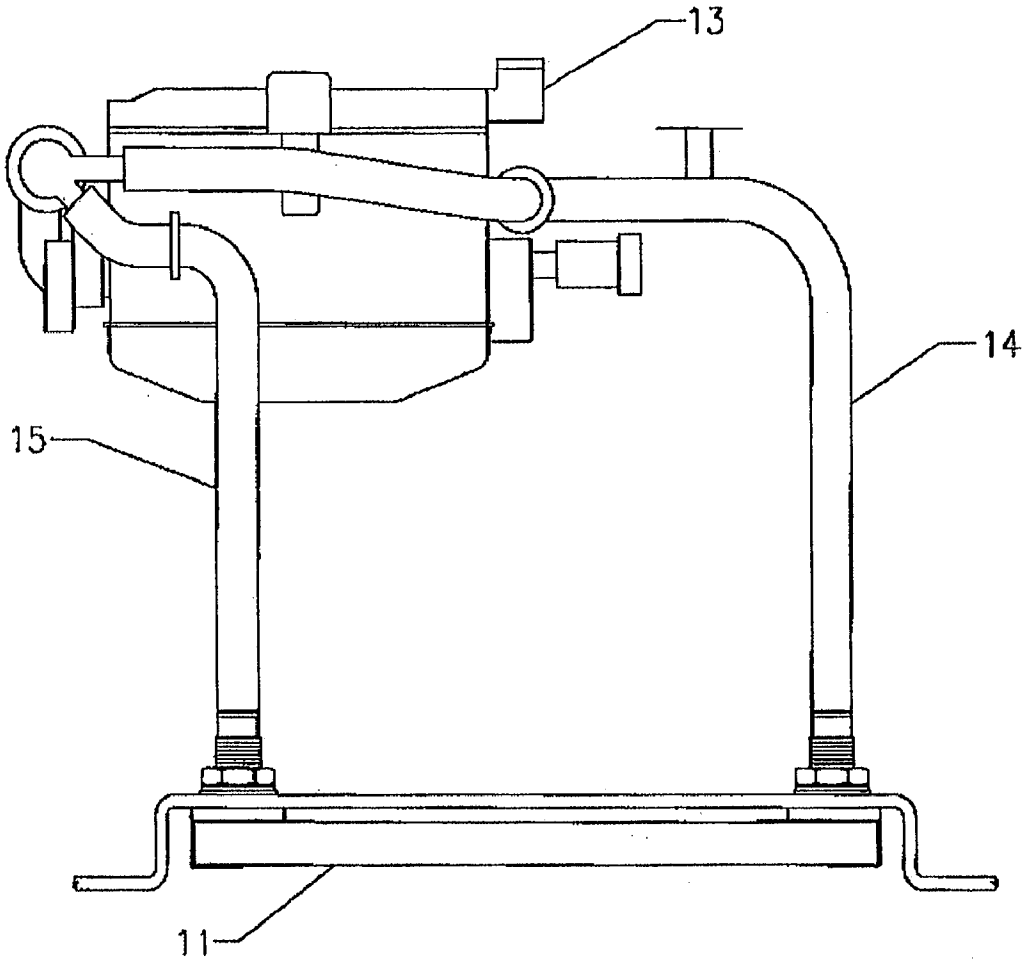
PRIOR ART FIG. 2
FIG. 2 is a side view of an engine for a vessel having a one-piece keel cooler according to the prior art installed on the vessel and connected to the engine.

FIG. 2 shows a heat exchanger 11 mounted on a vessel, for transferring heat from the coolant flowing from an engine or other heat source 13 to the ambient water. Coolant flows from one of lines 14 or 15 from engine 13 to keel cooler 11, and back through the other flow line from keel cooler 11 to engine 13. Keel cooler 11 is attached to, but spaced from the hull of a vessel. Keel cooler 11 is shown in prior art form.

Figure 3:
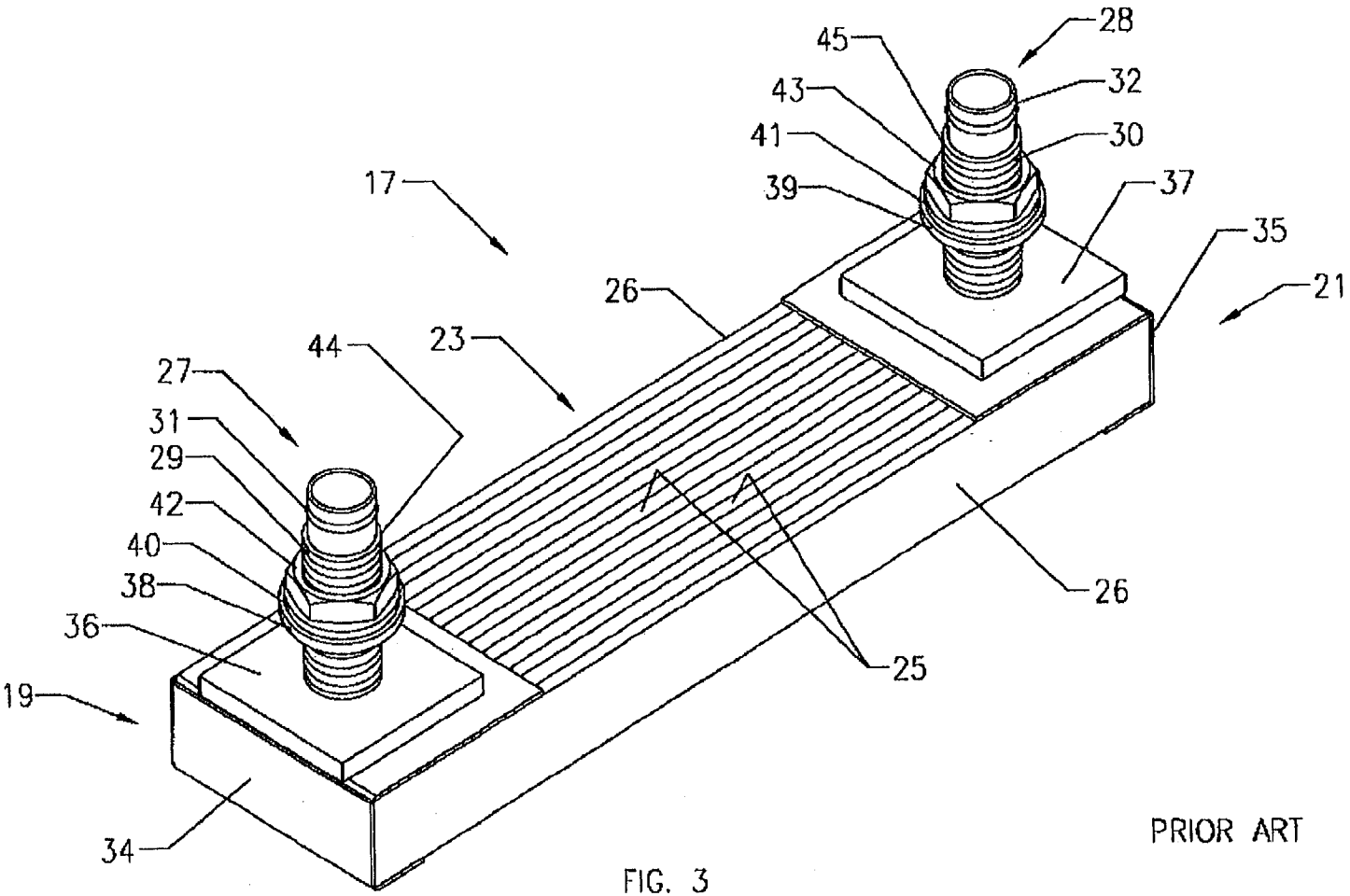
PRIOR ART FIG. 3
FIG. 3 is a pictorial view of a keel cooler according to the prior art.

A keel cooler 17 according to the prior art is shown in FIG. 3. It includes a pair of headers 19, 21 at opposite ends of a set of parallel, rectangular coolant flow tubes 23, having interior tubes 25 and two outermost tubes (discussed below). A pair of nozzles 27, 28 conduct coolant into and out of keel cooler 17. Nozzles 27, 28 have cylindrical threaded connectors 29, 30, and nipples 31, 32 at the ends of the nozzles.

Headers 19, 21 have a generally prismatic construction, and their ends 34, 35 are perpendicular to the parallel planes in which the upper and lower surfaces of tubes 23 are located. Keel cooler 17 is connected to the hull of a vessel through which nozzles 27 and 28 extend. Large gaskets 36, 37 each have one side against headers 19, 21 respectively, and the other side engages the hull of the vessel. Rubber washers 38, 39 are disposed on the inside of the hull when keel cooler 17 is installed on a vessel, and metal washers 40, 41 sit on rubber washers 38, 39. Nuts 42, 43, which typically are made from metal compatible with the nozzle, screw down on sets of threads 44, 45 on connectors 29, 30 to tighten the gaskets and rubber washers against the hull to hold keel cooler 17 in place and seal the hull penetrations from leaks.

Figure 4:
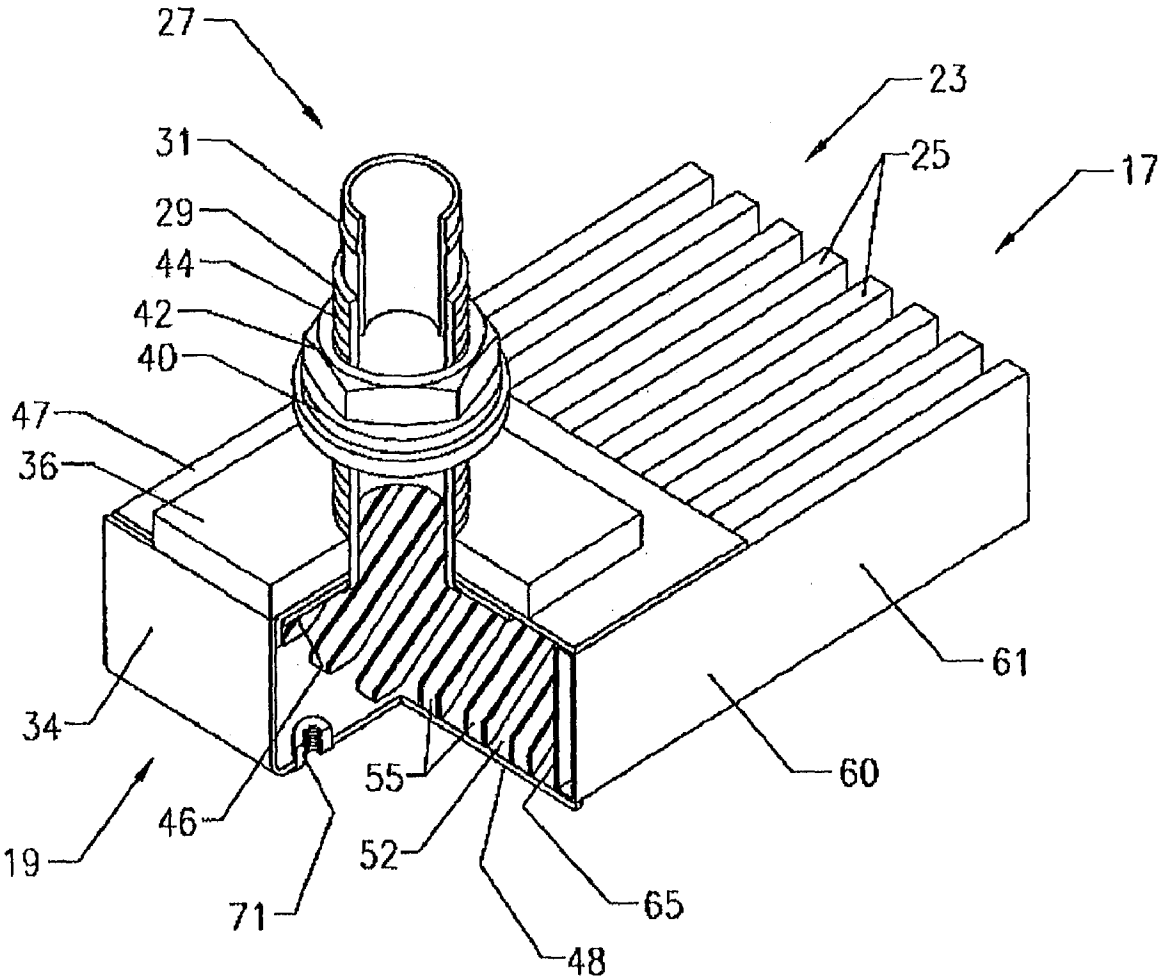
PRIOR ART FIG. 4
FIG. 4 is a partial pictorial view of a partially cut-away header and a portion of the coolant flow tubes of a one-piece keel cooler according to the prior art.

Turning to FIG. 4, a partial, cross section of the current keel cooler according to the prior art and depicted in FIG. 3, is shown. Keel cooler 17 is composed of the set of parallel heat conduction or coolant flow tubes 23 and the header or manifold 19. Nozzle 27 is connected to header 19 as described below. Nozzle 27 has nipple 31, and connector 29 has threads 44 as described above, as well as washer 40 and nut 42. Nipple 31 of nozzle 27 is normally brazed or welded inside of a connector 29 which extends inside the hull. Header 19 has an upper wall or roof 47, outer back wall 34, and a bottom wall or floor 48. Header 19 includes a series of fingers 52 which are inclined with respect to tubes 23, and define spaces to receive ends 55 of interior tubes 25.

Figure 5:
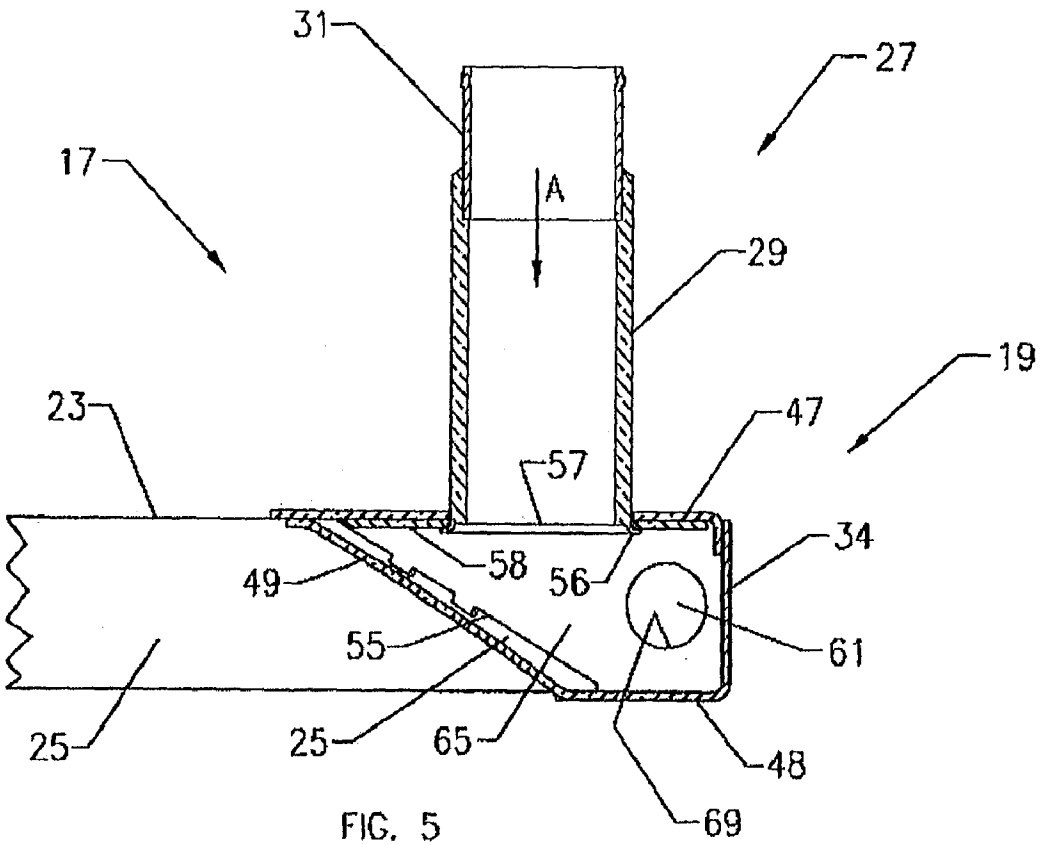
FIG. 5 PRIOR ART
FIG. 5 is a cross-sectional view of a portion of a keel cooler according to the prior art, showing a header and part of the coolant flow tubes.
Figure 6:
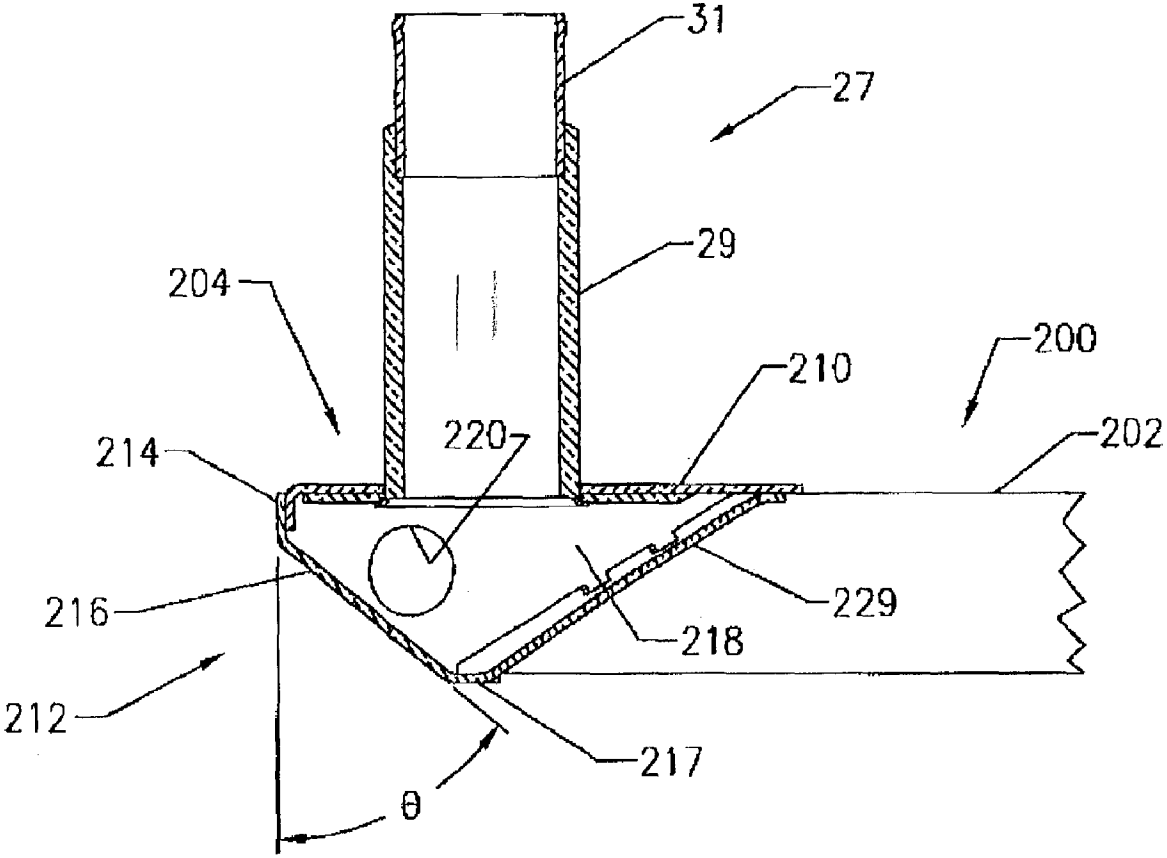
FIG. 6 is a side, cross-sectional, partial view of a portion of one-piece keel cooler according to the invention, showing a header and part of the coolant flow tubes.

Referring also to FIG. 5, which shows keel cooler 17 and header 19 in cross section, header 19 further includes an inclined surface 49 composed of fingers 52. End portions 55 of interior tubes 25 extend through surface 49. Interior tubes 25 are brazed or welded to fingers 52 to form a continuous surface. A flange 56 surrounds an inside orifice 57 through which nozzle 27 extends and is provided for helping support nozzle 27 in a perpendicular position on the header 19. Flange 56 engages a reinforcement plate 58 on the underside of wall 47.

In the discussion above and to follow, the terms "upper", "inner", "downward", "end", etc., refer to the heat exchanger, keel cooler or header as viewed in a horizontal position as shown in FIG. 5. This is done realizing that these units, such as when used on water going vessels, can be mounted on the side of the vessel, or inclined on the fore or aft end of the hull, or various other positions.

Each exterior side wall of header 19 is comprised of an exterior or outer rectangular tube, one of which is indicated by numeral 60 in FIG. 4. The outer tubes extend into header 19. FIGS. 4 and 5 show both sides of outside tube wall 61. Both sides of interior wall 65 are shown in FIGS. 4 and 5. A circular orifice 69 is shown extending through interior wall 65 of the outside rectangular tube of keel cooler 17, and is provided for carrying coolant flowing through the outside tube into or out of header 19. In this regard, nozzle 27 can either be an inlet conduit for receiving hot coolant from the engine whose flow is indicated by the arrow A in FIG. 5, or be an outlet conduit for receiving cooled coolant from header 19 for circulation back to the heat source.

FIG. 4 also shows that keel cooler header 19 has a drainage orifice 71 for receiving a correspondingly threaded and removable plug. The contents of keel cooler 17 can be removed through orifice 71.

Still referring to the prior art header 19 shown in FIGS. 3–5, it can be seen that outer back wall 34 and floor 48 are formed at right angles. This configuration has led to a number of disadvantages, previously unrecognized by those designing and working on keel coolers. First, by having wall 34 perpendicular to the direction of flow of the coolant through the tubes, greater pressure drops occur inside of header 19 as the coolant becomes chaotically turbulent and is forced through the coolant flow tubes at varying flow rates depending on resistance. This leads to a net reduction in flow and thus of heat transferred from the coolant through tubes 23 of keel cooler 17. With respect to the outside of wall 34, the vertical wall acts as an obstruction to the flow of ambient water, and diminishes the amount of ambient water which is able to flow between and around tubes 23. In addition, vertical wall 34 serves as an obstruction to debris in the ambient water and absorbs the full impact of the debris leading to potential damage to the keel cooler. Moreover, having wall 34 and floor 48 defining a right angle increases the amount of material used for keel cooler 17, which adds to its expense. Most keel coolers are made from 90-10 copper-nickel (or some other material having a large amount of copper), which is a relatively expensive material. In addition, significant drag is created by the resistance which the vertical wall presents to ambient water. This restricts the flow of ambient water to the heat exchange tubes of the keel cooler, and adds to the drag of the vessel as it moves through the water.

Still referring to FIGS. 3–5, gaskets 36, 37 are provided for three essential purposes: (1) they insulate the header to prevent galvanic corrosion, (2) they eliminate infiltration of ambient water into the vessel, and (3) they permit heat transfer in the space between the keel cooler tubes and the vessel by creating a distance of separation between the heat exchanger and the vessel hull, allowing ambient water to flow through that space. Gaskets 36, 37 are generally made from a polymeric substance. In typical situations, gaskets 36, 37 are between one-quarter inch and three-quarter inch thick. Keel cooler 17 is installed on a vessel as explained above. The plumbing from the vessel is attached by means of hoses to nipple 31 and connector 29 and to nipple 32 and connector 30. A cofferdam or sea chest (part of the vessel) at each end (not shown) contains both the portion of the nozzle 27 and nut 42 directly inside the hull. Sea chests are provided to prevent the flow of ambient water into the vessel should the keel cooler be severely damaged or torn away, where ambient water would otherwise flow with little restriction into the vessel at the penetration location.

Referring next to FIGS. 6–11, the invention in the preferred embodiment is shown. The embodiment includes a keel cooler 200 with coolant flow tubes (or heat transfer fluid flow tubes, since in some instances the fluid may be heated instead of cooled) 202 having a generally rectangular cross section. Coolant flow tubes 202 have a bottom portion 203. A header 204 is an integral part of keel cooler 200. Tubes 202 include interior or inner coolant flow tubes 206 and outermost or exterior tubes 208. A nozzle 27 having nipple 31 and threaded connector 29 is the same as those described earlier and are attached to the header. Header 204 includes an upper wall or roof 210 having interior surfaces 211 facing the chamber of the header, a beveled closed end portion 212 having an end wall 214 transverse to (and preferably perpendicular to) upper wall 210 and a beveled wall 216 beginning at end wall 214 and terminating at a generally flat lower wall or bottommost portion 217, the bottommost portion of the header. Bottommost portion or lower wall 217 is not above bottom portions 203 of coolant flow tubes 202 to provide an enhanced ambient fluid flow pattern as compared to a heat exchanger having a header with a bottommost portion below the bottom portion of the coolant flow tubes. Beveled wall 216 should be greater in length (from end wall 214 to lower wall 217) than the height of end wall 214. An interior wall 218 (FIGS. 6–7) of exterior or outermost rectangular flow tube 208 has an orifice 220 (one per header for each tube 208) which is provided as a coolant flow port for coolant flowing between the chamber of header 204 and outer flow tubes 208. (The chamber is defined by upper wall 210, an inclined surface or inner end or inlet end portion 229, beveled wall 216, lower wall 217 and end wall 214.) Header 204 also has an anode assembly (not shown) for reducing corrosion of the keel cooler.

Figure 7:
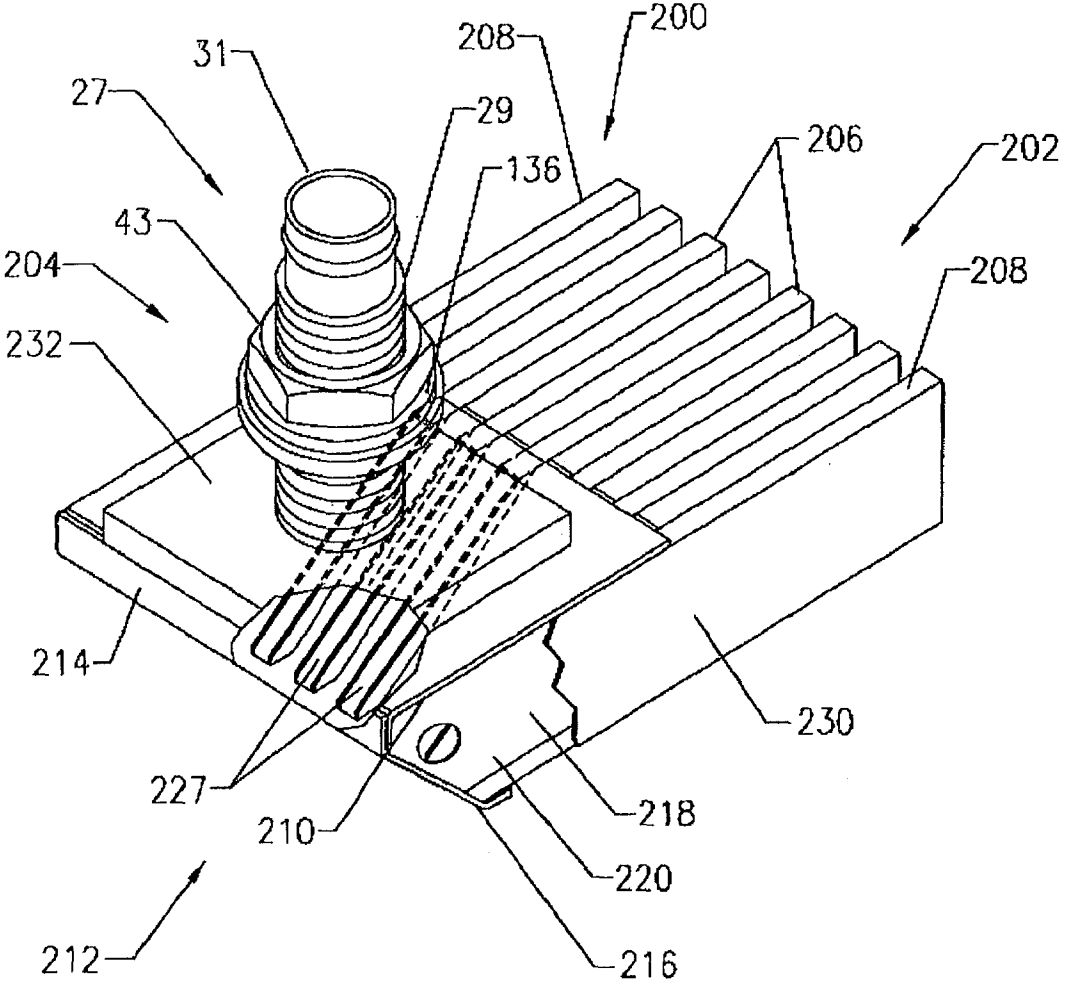
FIG. 7 is a pictorial view of a portion of a one-piece keel cooler according to the invention, with portions cut away.
Figure 9:
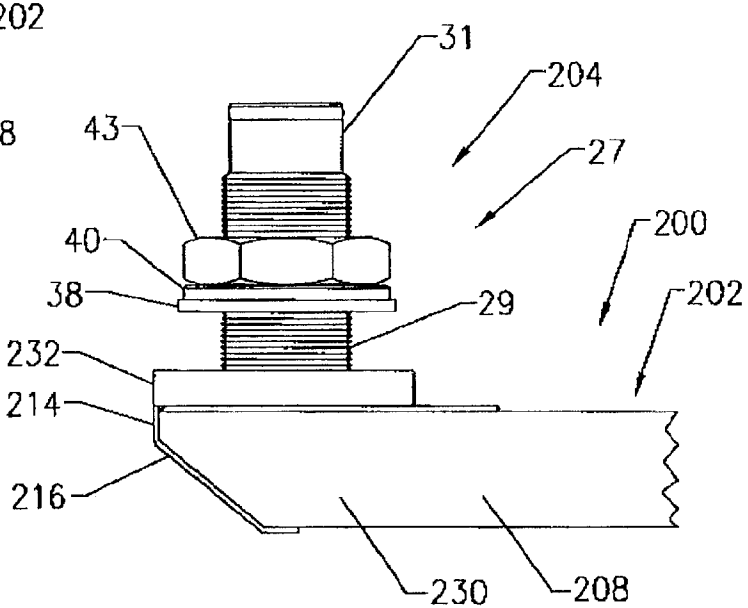
FIG. 9 is a side view of part of the apparatus shown in FIG. 8.
Figure 8:
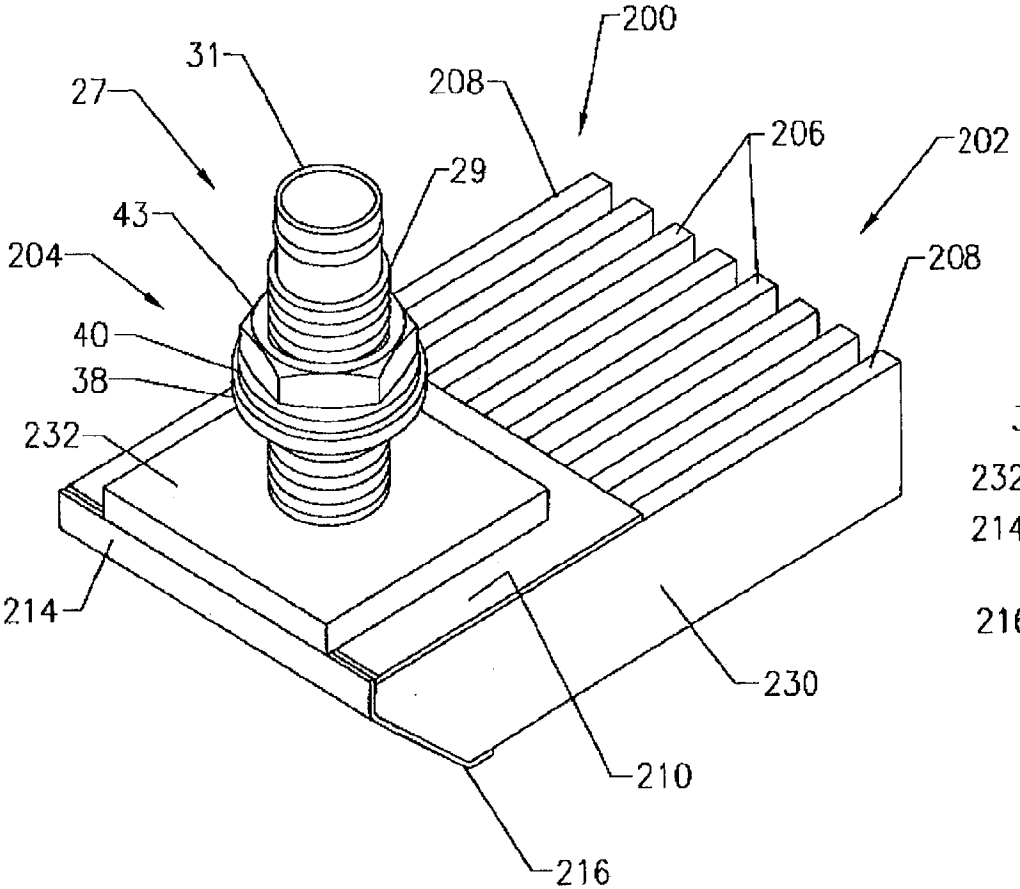
FIG. 8 is a pictorial view of a header and part of the coolant flow tubes of a one-piece keel cooler according to the invention.
Figure 11:
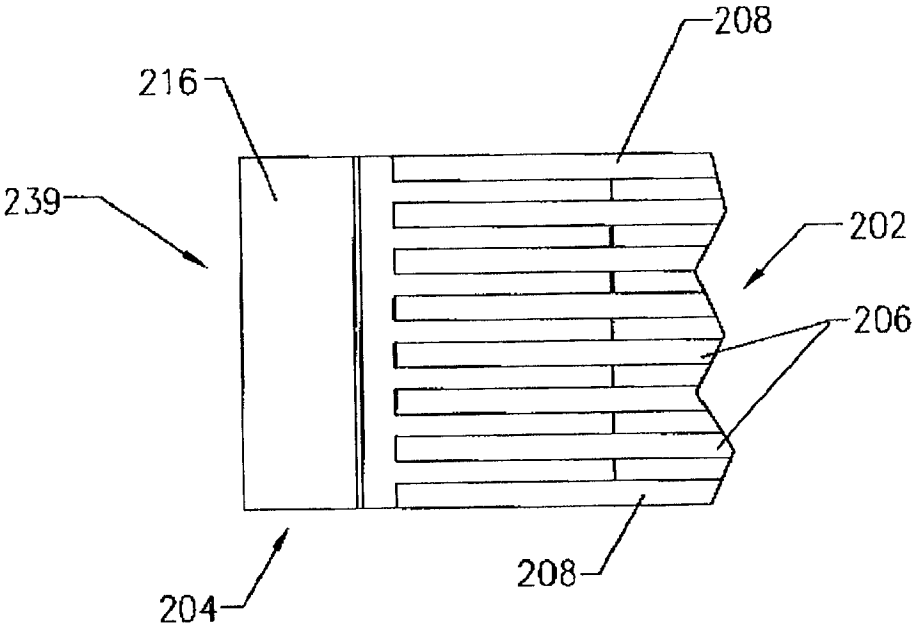
FIG. 11 is a partial bottom view of the apparatus shown in FIG. 8.
Figure 10:
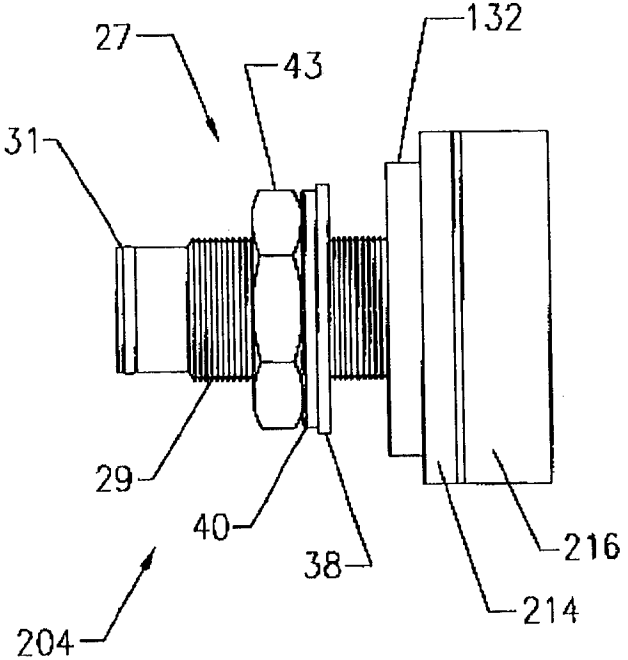
FIG. 10 is a front view of the apparatus shown in FIG. 8.

Considering specifically cut away FIG. 7, keel cooler 200 includes rectangular tubes 202 with interior tubes 206 and outermost tubes 208, and inner wall 218 (with orifice 220) of the outermost tubes. The open ends or inlets or ports for interior tubes 206 are shown by numerals 227. Tubes 206 join header 204 through inclined surface 229 (FIG. 6) on the opposite part of header 204 from beveled wall 216. Exterior tubes 208 have outer walls or exterior surfaces 230, part of which are also the side walls of header 204. A gasket 232, similar to and for the same purpose as gasket 36, is disposed on roof 210.

The angle of beveled wall 216 is an important part of the present invention. As discussed herein, the angle, designated as θ (theta), is appropriately measured from the plane perpendicular to the longitudinal direction of coolant flow tubes 202 and located at the part of the closed end portion of header 204 spaced furthest from the set of open ends or ports 227 of tubes 206, i.e. from end wall 214, to beveled wall 216. Angle θ is described as an exterior angle, since it is exterior to end wall 214 and beveled wall 216; it is measured from a plane perpendicular to the longitudinal axes of the flow tubes 202 and roof 210, and it is along end wall 214 at the beginning of beveled wall 216. The factors for determining angle θ are to maintain the center-to center distance of the nozzle spacing, to maintain the overall length of the keel cooler, to provide vertical drop beneath the roof of the header so that the header can hold the anode insert, to keep the anode assembly from extending longitudinally beyond wall 214, and to allow for the maximum length of heat transfer tubing (and the associated reduction of the length of the header). Angle θ could be affected by the size of orifice 220, but generally the other factors limit angle θ before the orifice would affect it.

Another important aspect to beveled wall 216 is the manner in which it directs the flow of ambient water over and between the exterior walls of coolant flow tubes 202, to increase the heat transfer between the coolant inside the tubes and the outside ambient water. It will be recalled that under the prior art as shown in FIGS. 3–5, vertical wall 34 diverted the ambient water as the vessel passed therethrough, so that the ambient water to a significant extent went around rather than between and over the separated rectangular tubes 27.

Figure 12:
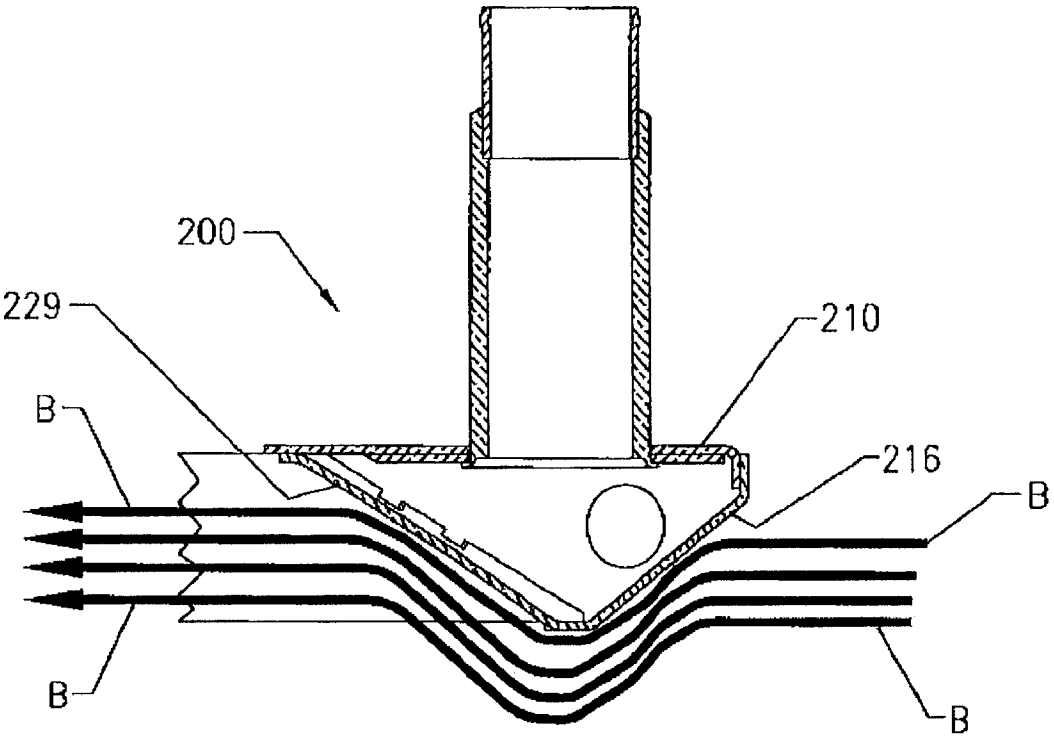
FIG. 12 is a side view of a portion of a header according to the invention showing the flow lines of ambient water.

Referring to FIG. 12, which shows a side view of keel cooler 200, arrows B show the flow pattern of ambient water across keel cooler 200 as the keel cooler moves to the right through the ambient water. Arrows B show that the water impinges on beveled wall 216, flows around the beveled wall, and, due to the drop in pressure, along inclined surface 229 and up and between coolant flow tubes 202. This flow is turbulent which greatly increases the transfer of heat from the heat conduction tubes as compared to the prior art shown in FIGS. 3–5, yielding a more efficient and effective heat exchanger than those of the prior art.

It can be seen that outer exterior surfaces 230 define an envelope transverse to the longitudinal direction of the keel cooler. The envelope has a height equal to the exterior height of exterior tubes 208, and a width equal to the distance between outer exterior surfaces 230. Header 204 thus has an exterior width equal to the width of the envelope and an interior height defined by the interior surfaces of upper wall 210 and lower wall 217, and therefore of the envelope.

So far, only single-pass keel cooler systems have been described. In two-pass systems, the inlet and outlet nozzles are both disposed in one header, and coolant flows into the header via an inlet nozzle, through a first set of tubes from the first header into the second header (with no nozzles), and then back through a second set of tubes at a lower pressure—and finally out from the header via an outlet nozzle. Referring to FIGS. 14 and 15, a two-pass keel cooler 300 according to the invention is shown. Keel cooler 300 has two sets of coolant flow tubes 302, 304, a header 306 and an opposite header 308. Header 306 has an inlet nozzle 310 and an outlet nozzle 312, which extend through a gasket 314. Header 306 further has a beveled end wall 315 having the advantages with respect to both internal coolant flow and to ambient water flow as discussed earlier. Gasket(s) 314 is located on roof 316 of header 306. The other header 308 has no nozzles, but rather has one or two stud bolt assemblies 318, 320 for connecting the portion of the keel cooler which includes header 308 to the hull of the vessel. Header 308 has a beveled end wall 321 which provides the advantages over flat end walls with respect to ambient water flow as explained above. The hot coolant from the engine or generator of the vessel enters nozzle 310 as shown by arrow C, and the cooled coolant returns to the engine from header 306 through outlet nozzle 312 shown by the arrow D. Outermost tubes 322, 324 are like outer tubes 208 in FIGS. 7, 8 and 11 in that orifices corresponding to orifice 220 direct coolant into tube 322 and from tube 324. In addition, a tube 326 serves as a separator tube for delivering inlet coolant from header 306 to header 308, and it has an orifice (not shown) for receiving coolant for separator tube 326 under high pressure from a part of header 306 as discussed below. Similarly, a tube 327 which is the return separator tube for carrying coolant from header 308, also has an orifice 328 in header 306.

For space limitations or assembly considerations, sometimes (as noted above) it is necessary to remove the inner wall or a section of the inner tube instead of one or the other of the orifices. Other times, a separator plate is used and the standard angle interior tubes are used instead of separator tubes.

Keel cooler 300 has one set of coolant flow tubes 302 for carrying hot coolant from header 306 to header 308, where the direction of coolant flow is turned 180° by header 308, and the coolant enters a second set of tubes 304 for returning the partially cooled coolant back to header 306. Thus, coolant under high pressure flows through tubes 302 from header 306 to header 308, and the coolant then returns through tubes 304, and subsequently through nozzle 312 to the engine or other heat source of the vessel. Walls 334 and 336 (shown in FIG. 15) of tubes 326 and 327 in header 306 are solid, and act as separators to prevent the mixing of the hot coolant going into coolant flow tubes 302, and the cooled coolant flowing from tubes 304. There is a fairly uniform rate of flow through the tubes in both directions. Such efficient systems have been unable to be produced under the prior art, since the pressure drop across all six (or as many as would be realistically considered) orifices made the prior keel coolers too inefficient due to poor coolant distribution to be operated without a substantial additional safety factor. That is, in order to have two-pass systems, prior one piece keel cooler systems having two-pass arrangements are up to 20% larger than those required pursuant to the present invention to provide sufficient heat exchange surfaces to remove the required amount of heat from the coolant while attempting to maintain acceptable pressure drops.

The keel cooler system shown in FIG. 14 has 8 flow tubes. However, the two-pass system would be appropriate for any even number of tubes, especially for those above two tubes. There are presently keel coolers having as many as 24 tubes, but it is possible according to the present invention for the number of tubes to be increased even further. These can also be keel coolers with more than two passes. If the number of passes is even, both nozzles are located in the same header. If the number of passes is an odd number, there is one nozzle located in each header.

Another aspect of the present invention is shown in FIG. 16, which shows a multiple systems combined keel cooler which has heretofore not been practically possible with one-piece keel coolers. Multiple systems combined can be used for cooling two or more heat sources, such as two relatively small engines or an aftercooler and a gear box in a single vessel. Although the embodiment shown in FIG. 16 shows two keel cooler systems, there could be additional ones as well, depending on the situation. As explained below, the present invention allows multiple systems to be far more efficient than they could have been in the past. Thus, FIG. 16 shows a multiple systems keel cooler 400. Keel cooler 400 has a set of heat conducting or coolant flow tubes 402 having outermost tubes 404 and 406, which have orifices at their respective inner walls which are similar in size and position to those shown in the previously described embodiments of the invention. For two single-pass, multiple systems combined, keel cooler 400 has identical headers 408 and 410, having inlet nozzles 412, 416 respectively, and outlet nozzles 414, 418 respectively. Both nozzles in respective headers 408 and 410 could be reversed with respect to the direction of flow in them, or one could be an inlet and the other could be an outlet nozzle for the respective headers. Arrows E, F, G and H show the direction of the coolant flow through the nozzles respectively. A set of tubes 420 for conducting coolant between nozzles 412 and 418 commence with outermost tube 404 and terminate with separator tube 422, and a set of tubes 424 extending between nozzles 414 and 416, commencing with outermost tube 406 and terminating with separator tube 426. The walls of tubes 422 and 426 which are adjacent to each other are solid, and extend between the end walls of headers 408 and 410. These walls thus form system separators, which prevent the flow of coolant across these walls, so that the tubes 420 form, in effect, one keel cooler, and tubes 424 form, in effect, a second keel cooler (along with their respective headers). Keel cooler 400 has beveled closed end portions 428, 430 as discussed earlier. Header 408 has a beveled end wall 409, and header 410 has a beveled end wall 411, all having the advantages with respect to internal coolant flow and ambient flow as discussed above. This type of keel cooler can be more economical than having two separate keel coolers, since there is a savings by only requiring two headers, rather than four. Multiple keel coolers can be combined in various combinations. There can be two or more one-pass systems as shown in FIG. 16.

There can be one or more single-pass systems and one or more double-pass systems in combination as shown in FIG. 17. In FIG. 17, a keel cooler 500 is depicted having a single-pass keel cooler portion 502, and a double-pass keel cooler portion 504. Keel cooler portion 502 functions as that described with reference to FIGS. 6–11, and keel cooler portion 504 functions as that described with reference to FIGS. 14 and 15. FIG. 17 shows a double-pass system for one heat exchanger, and additional double-pass systems could be added as well. Keel cooler 500 has beveled end walls 506, 508, with the advantages over the prior art with respect to internal coolant flow and external ambient liquid flow as discussed above.

FIG. 18, shows a keel cooler 600 having 2 double-pass keel cooler portions 602, 604, which can be identical or have different capacities. They each function as described above with respect to FIGS. 14 and 15, and have beveled end walls as discussed earlier. Multiple coolers combined are a powerful feature not found in prior one-piece keel coolers. The modification of the special separator/tube design improves heat transfer and flow distribution while minimizing pressure drop concerns.

The keel coolers described above show nozzles for transferring heat transfer fluid into or out of the keel cooler. However, there are other means for transferring fluid into or out of the keel cooler; for example, in flange mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

Figure 13:
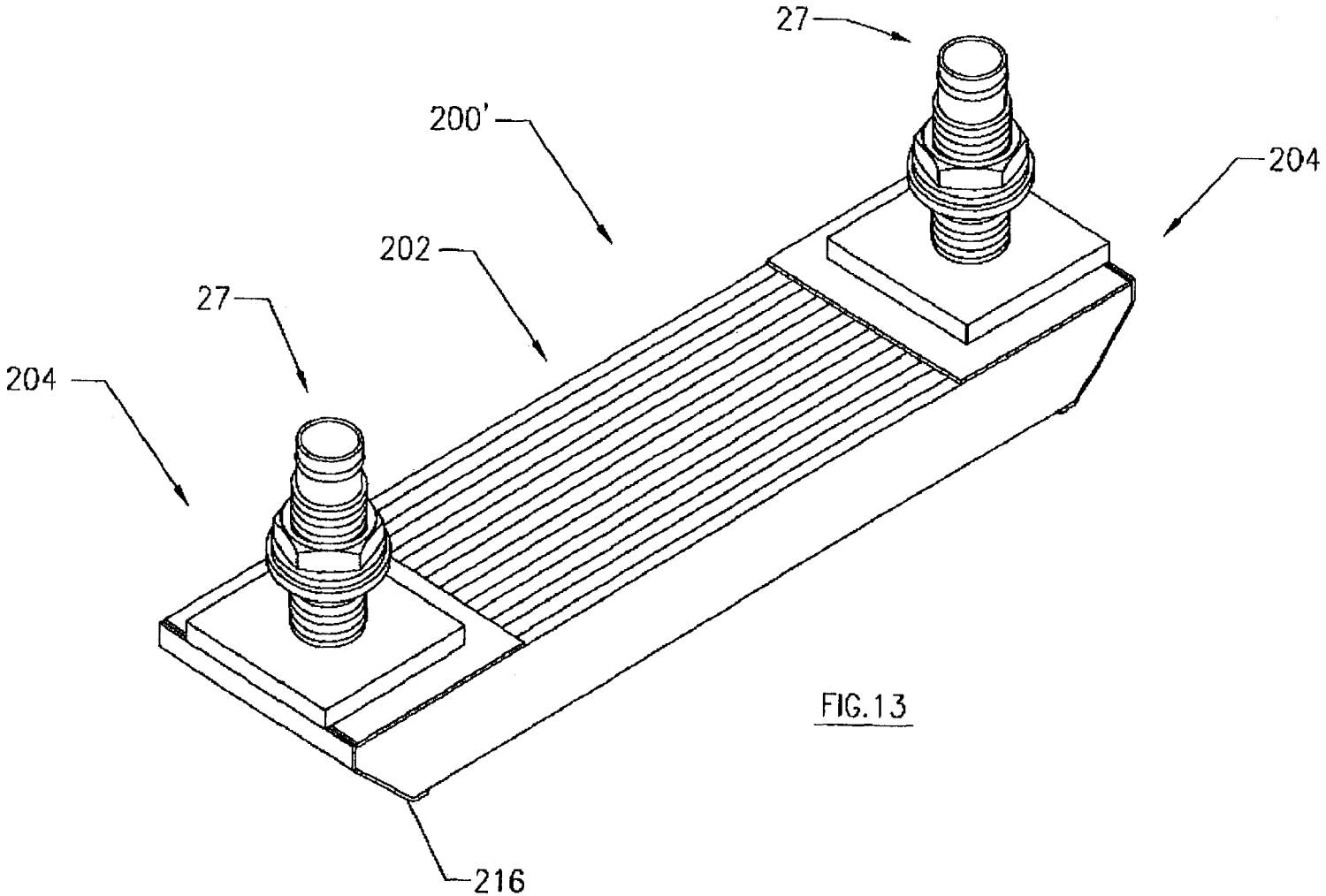
FIG. 13 is a pictorial view of a keel cooler according to the invention.

Keel coolers according to the invention are used as they have been in the prior art, and incorporate two headers which are connected by an array of parallel coolant flow tubes. A common keel cooler according to the invention is shown in FIG. 13, which illustrates a keel cooler 200' having opposing headers 204 like the one shown in FIG. 7. The headers shown have the identical numbers to those shown in FIG. 7. Heated coolant fluid flows into one nozzle 27 from a heat source in the vessel, then flows through one header 204, the coolant flow tubes 202, the other header 204, the other nozzle 27, and the cooled coolant flows back to the heat source in the vessel. While flowing through headers 204 and coolant flow tubes 202, the coolant transfers heat to the ambient water. All of the advantages of the beveled wall 216 apply to keel cooler 200'.

The keel coolers described above show nozzles for transferring heat transfer fluid into or out of the headers. However, there are other means for transferring fluid into or out of the headers; for example, in flange mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

The invention has been described with particular reference to the preferred embodiments thereof, but it should be understood that variations and modifications within the spirit and scope of the invention may occur to those skilled in the art to which the invention pertains.

What is claimed is:

1. A header for a heat exchanger, the heat exchanger having a plurality of parallel tubes extending in a longitudinal direction and having generally rectangular cross sections, the tubes including a pair of outermost tubes and at least one inner tube located between the outermost tubes, the outermost tubes having a flat outside wall and a parallel flat inside wall, and the inner tubes having coolant ports, said header comprising:

a flat upper wall having a flat upper end portion, opposing flat side portions and a flat upper inner portion, said flat upper end portion and said flat upper inner portion being located in a plane, and an inlet/outlet opening for permitting the flow of coolant along a projected flow path determined by a projection of said opening into said header, between an inlet/outlet and said header, said flat upper wall having a length extending between said flat upper end portion and said flat upper inner portion;

a flat lower wall located below said upper wall, said flat lower wall having a flat lower end portion, opposing flat side portions and a flat lower inner portion, said flat lower wall having a length extending between the flat lower end portion and the flat lower inner portion, said length being less than the length of said flat upper wall and disposed inwardly from both the upper end portion and the upper inner portion of said flat upper wall;

a flat end wall extending generally perpendicularly from the flat end portion of said flat upper wall and terminating below said flat upper wall and above said flat lower wall, said flat end wall having a height;

an inclined surface extending between the flat inner portions of said flat lower wall and said flat upper wall, and including at least a portion of the open end(s) of the at least one inner tube to said header;

at least one of said open ends being located in the projected flow path of the inlet/outlet opening;

flat outside side walls extending between the flat side portions of said flat upper wall and said flat lower wall, said flat outside side walls each being an extension of the flat outside wall of the outermost tube of the heat exchanger;

flat inside side walls parallel to said flat outside side walls, said flat inside side walls each being an extension of the flat inside wall of the outermost tube; and a flat beveled wall extending between the termination of said flat end wall and the end portion of said flat lower wall and beveled with respect to said longitudinal direction for directing coolant flow between said inlet/outlet and said open ends and reducing the turbulence of coolant flow to and/or from said parallel tubes and increasing ambient fluid flow to the exterior surfaces of said parallel tubes compared to a non-beveled wall, said flat beveled wall having a length substantially greater than the height of said end wall;

the inner surfaces of said flat inside side walls, flat upper wall, flat end wall, flat lower wall, flat beveled wall and inclined surface forming a header chamber;

said flat inside side walls each having at least one orifice for permitting the flow of coolant between said header chamber and the respective outermost tube.

2. A header according to claim 1 wherein a portion of said open ends of the at least one inner tube is adjacent to said lower wall.

3. A heat exchanger according to claim 1 wherein said flat upper wall lies generally in a plane, and the amount of bevel of said flat beveled wall is at an exterior angle θ measured from the plane of said flat end wall, angle θ being no less than 20° and no greater than 70°.

4. A heat exchanger according to claim 1 wherein said flat beveled wall joins said flat lower wall along a line extending through the projected flow path.

5. A heat exchanger according to claim 1 wherein said flat lower wall extends across the general middle of the projection of said inlet/outlet opening, and said flat beveled wall joins said flat lower wall along a line extending through said projection near the middle of said projection.

6. A one-piece heat exchanger comprising:

a plurality of coolant/heating fluid flow tubes extending in a longitudinal direction for carrying a selected one of coolant fluid from a heat source for transferring heat from the coolant fluid cooling medium and for returning the cooled coolant fluid back to the heat source or heating fluid from a heat source for transferring heat from the heat source for heating and for returning the cooled heating fluid back to the heat source, said coolant/heating fluid flow tubes having a set of inner tubes and outermost side tubes, said inner tubes having at least one set of open ports proximate each other; and a header connected to said coolant/heating fluid flow tubes at said at least one set of open ports of said tubes, said header comprising an inclined inner surface including said open ports for receiving coolant from and/or delivering coolant to said coolant/heating fluid flow tubes, a portion of said open ports being located at the lowest part of said inclined inner surface;

a flat upper wall having a flat upper end portion, opposing flat side portions and a flat upper inner portion, said flat upper end portion and said flat upper inner portion being located in a plane, and an inlet/outlet opening for permitting the flow of coolant along a projected flow path determined by a projection of said opening into said header, between an inlet/outlet and said header, said flat upper wall having a length extending between said flat upper end portion and said flat upper inner portion;

a flat lower wall having a length less than the length of said flat upper wall and being disposed inwardly of both the flat upper end portion and the flat upper inner portion of said upper wall;

a flat closed end portion opposite said inclined inner surface, said flat closed end portion having a flat end wall extending generally perpendicularly from the flat upper end portion of said flat upper wall, said flat end wall having a height, and a flat beveled wall beveled from said flat end wall and extending away from said flat upper wall and intersecting said flat lower wall, said flat beveled wall terminating in said projected flow path, for reducing turbulence and pressure drop of coolant flow to and/or from said coolant/heating fluid flow tubes and for increasing ambient fluid flow to the exterior surfaces of said coolant/heating fluid flow tubes compared to a non-beveled wall, said flat beveled wall having a length substantially greater than the height of said flat end wall:

opposing flat outside side walls, each of said flat side walls being an extension of the flat outside side walls of said outermost side tubes; and flat inside side walls parallel to said flat outside side walls, said flat inside side walls each being an extension of the flat inside wall of an outermost tube, and having an orifice for permitting the flow of coolant between a chamber defined within said header and the respective outermost tube.

7. A heat exchanger according to claim 6 wherein said flat upper wall lies generally in a plane, and said flat closed end portion further includes a flat flat end wall being generally in a plane perpendicular to the plane of said flat upper wall, and an end of said flat beveled wall is at said flat end wall.

8. A heat exchanger according to claim 7 wherein the amount of bevel of said flat beveled wall is at an exterior angle θ measured from the plane of said end wall, angle θ being no less than 20° and no greater than 70°.

9. A heat exchanger according to claim 6 wherein said flat lower wall is parallel to said flat upper wall and forms a juncture between said inclined inner surface and said flat beveled wall.

10. A heat exchanger according to claim 9 wherein said flat lower wall extends across the general middle of the projection of said inlet/outlet opening, and said flat beveled wall joins said flat lower wall along a line extending through said projection near the middle of said projection.

* * * * *